US008474166B2

(12) United States Patent
Reynolds

(10) Patent No.: US 8,474,166 B2
(45) Date of Patent: Jul. 2, 2013

(54) METHOD OF ASSEMBLING A TENSILE FABRIC ARRANGEMENT

(75) Inventor: Phillip John Reynolds, Bramhall (GB)

(73) Assignee: Cestrian Imaging Limited, Cheshire (GB)

( * ) Notice: Subject to any disclaimer, the term of this patent is extended or adjusted under 35 U.S.C. 154(b) by 136 days.

(21) Appl. No.: 12/867,978

(22) PCT Filed: Feb. 18, 2009

(86) PCT No.: PCT/GB2009/000429
§ 371 (c)(1),
(2), (4) Date: Mar. 22, 2011

(87) PCT Pub. No.: WO2009/103958
PCT Pub. Date: Aug. 27, 2009

(65) Prior Publication Data

US 2011/0162244 A1 Jul. 7, 2011

(30) Foreign Application Priority Data

Feb. 18, 2008 (GB) ..... 0802928.2

(51) Int. Cl.
*G09F 17/00* (2006.01)

(52) U.S. Cl.
USPC ..... 40/604; 160/368.1; 40/603

(58) Field of Classification Search
USPC ..... 242/400, 400.1, 405, 405.1; 269/3, 269/6, 95; 40/590, 596, 603, 604
See application file for complete search history.

(56) References Cited

U.S. PATENT DOCUMENTS

| | | | | |
|---|---|---|---|---|
| 492,570 | A * | 2/1893 | Casey | 81/3.36 |
| 1,426,969 | A * | 8/1922 | Dunham | 160/199 |
| 2,163,359 | A * | 6/1939 | Van Derveer | 160/378 |
| 2,556,400 | A * | 6/1951 | Schwartz | 24/706.1 |
| 2,893,147 | A * | 7/1959 | Mollet, III | 40/604 |
| 3,182,672 | A * | 5/1965 | Biller, Jr. | 135/117 |

(Continued)

FOREIGN PATENT DOCUMENTS

| | | |
|---|---|---|
| DE | 20121195 U1 | 6/2002 |
| EP | 0564657 A1 | 10/1993 |

(Continued)

OTHER PUBLICATIONS

International Search Report for PCT International Patent Application No. PCT/GB2009/000429, mailed on Aug. 6, 2009.

*Primary Examiner* — Joanne Silbermann
*Assistant Examiner* — Shin Kim
(74) *Attorney, Agent, or Firm* — Pillsbury Winthrop Shaw Pittman LLP

(57) ABSTRACT

The present invention provides a method of assembling a tensile fabric arrangement comprising engaging an end of a carrier member having a tensile fabric attached thereto with a first support member attached to a surface, engaging a second end of the carrier member with a locking member, extending the tensile fabric from the carrier member, engaging an end of a second carrier member for the tensile fabric with a second support member attached to the surface, engaging a second end of the second carrier member with a securing member; and applying a tension to the tensile fabric, wherein the tensile fabric is supported at its top edge only by the first and second support members but may optionally be further tensioned using a tensile structural assembly including a surface, guide hook, loop, and tie, which is also provided.

7 Claims, 21 Drawing Sheets

U.S. PATENT DOCUMENTS

| | | | | | |
|---|---|---|---|---|---|
| 3,276,512 | A * | 10/1966 | Gallagher | 160/368.1 |
| 3,912,214 | A * | 10/1975 | Karass | 248/323 |
| 3,950,019 | A * | 4/1976 | Dugan | 292/264 |
| 3,953,065 | A * | 4/1976 | Shannon, Jr. | 294/103.1 |
| 3,984,931 | A * | 10/1976 | Belokin, Jr. | 40/559 |
| 4,334,445 | A * | 6/1982 | Timewell | 81/177.7 |
| 4,739,568 | A * | 4/1988 | Gearhart | 40/603 |
| 4,773,174 | A * | 9/1988 | Boeniger et al. | 40/792 |
| 4,776,121 | A * | 10/1988 | Vicino | 40/610 |
| 4,875,549 | A * | 10/1989 | Denny et al. | 182/138 |
| 4,906,503 | A * | 3/1990 | De La Cruz et al. | 428/81 |
| 5,058,299 | A * | 10/1991 | Suzuki | 40/603 |
| 5,303,726 | A * | 4/1994 | Merrill | 135/88.1 |
| 5,507,109 | A * | 4/1996 | Rinzler | 40/603 |
| 5,649,390 | A * | 7/1997 | Davidson | 52/3 |
| 5,664,354 | A * | 9/1997 | Daviau et al. | 40/603 |
| 5,709,706 | A * | 1/1998 | Kienzle et al. | 606/205 |
| 5,823,592 | A * | 10/1998 | Kalidindi | 294/24 |
| 6,006,399 | A * | 12/1999 | Massaro | 15/315 |
| 6,092,319 | A * | 7/2000 | Hicks | 40/603 |
| 6,282,822 | B1 * | 9/2001 | Rinzler et al. | 40/590 |
| 6,339,889 | B1 * | 1/2002 | Griesemer et al. | 40/603 |
| 7,117,620 | B2 * | 10/2006 | Tolna | 40/601 |
| 7,168,197 | B2 * | 1/2007 | Siegenthaler | 40/603 |
| 7,191,555 | B2 * | 3/2007 | Hughes | 40/603 |
| 7,774,967 | B1 * | 8/2010 | Jones et al. | 40/604 |
| 8,113,259 | B2 * | 2/2012 | Tessmer | 160/54 |
| 8,117,951 | B2 * | 2/2012 | Brobst | 81/177.8 |
| 2003/0200685 | A1 * | 10/2003 | Gibb | 40/603 |
| 2005/0262743 | A1 * | 12/2005 | Siegenthaler | 40/603 |
| 2006/0174525 | A1 * | 8/2006 | Hughes | 40/603 |
| 2006/0207141 | A1 * | 9/2006 | Pitt et al. | 40/590 |
| 2008/0301988 | A1 * | 12/2008 | Strader | 40/604 |
| 2009/0172984 | A1 * | 7/2009 | Pulliam | 40/603 |
| 2010/0083546 | A1 * | 4/2010 | Troiano et al. | 40/603 |

FOREIGN PATENT DOCUMENTS

| | | | |
|---|---|---|---|
| JP | 11-175005 | A | 7/1999 |
| JP | 2003-248450 | A | 9/2003 |
| JP | 2006-030675 | A | 9/2003 |
| JP | 2006-030953 | A | 2/2006 |
| WO | 2009/037442 | A1 | 3/2009 |

* cited by examiner

85

85

METHOD OF ASSEMBLING A TENSILE FABRIC ARRANGEMENT

CROSS-REFERENCE TO RELATED APPLICATIONS

This is the U.S. National Stage of PCT/GB2009/000429 filed Feb. 18, 2009, which in turn claims priority to Great Britain Application No. 0802928.2, filed Feb. 18, 2008, the entire contents of both applications are incorporated herein by reference in their entireties.

This invention relates to a method of assembling a tensile fabric arrangement, to a tensile structural assembly which can be used for creating the tensile fabric arrangement, and to tensioned structures, such as tensile fabric or filmic structures for e.g. billboards, shelters and canopies, and tensioned linear structures such as hoisted flags or banners.

Methods of assembling tensile fabric arrangements, such as tensioned fabric or filmic printed materials for billboards, have been known for over 100 years. The old-fashioned method of using a bucket of paste to adhere posters to billboards is still widely used to this day, even though it requires the use of a ladder and is time-consuming and awkward. Adhering the pieces to the surface and lining them up to create the desired picture usually takes about 20 minutes to complete. However, health and safety regulations have recently been implemented which restrict or prevent people climbing ladders to attach the posters to the billboards without the aid of safety equipment.

Tensioned fabric and filmic structures are well known, for example for providing shelter from rain or sun. Tensioned fabric or filmic printed materials for billboards are also known, including framing systems providing retention and optional tensioning of the printed material. Elasticated materials are known including elastic cord sometimes referred to as "shock cord" or "bungee cord". Means of structural connections to fabrics or films are also known, for example eyelet holes with annular metal reinforcers, or gripper devices, such as holdon two-part gripper devices, or edge seams containing cable. These are used to distribute local stresses in fabric or filmic structures, for example at the connection points to associated tensioned cables, springs or tie rods, such as tie rods comprising a turnbuckle tensioning device.

It is an object of the present invention to provide a method of assembling a tensile fabric arrangement which is quicker and safer than existing methods.

There is therefore provided a method of assembling a tensile fabric arrangement comprising the steps of:

(i) engaging an end of a carrier member for a tensile fabric with a first support member attached to a surface;

(ii) engaging a second end of the carrier member with a locking member;

(iii) extending the tensile fabric from the carrier member;

(iv) engaging an end of a second carrier member for the tensile fabric with a second support member attached to the surface;

(v) engaging a second end of the second carrier member with a securing member; and (vi) applying a tension to the tensile fabric, wherein the tensile fabric is supported at its top edge only by the first and second support members and wherein the steps of the method may also be carried out in the order (iv), (v), (iii), (i), (ii) and (vi).

It will be appreciated that the method can be equally effectively carried out irrespective of in which order the above-defined steps is carried out, and both orders are envisaged within the scope of the invention.

According to another aspect of the present invention, the tensile fabric is further supported at its top edge using a tensile structural assembly which comprises one or more discrete guide hooks. No sliding mechanism is required at the top edge of the tensile fabric to support across the length thereof or to extend it.

According to a further aspect, the tensile structural assembly further comprises a surface, which may or may not be the same surface to which the first and second support members are attached although typically it is the same surface, a loop and a tie, wherein the guide hook is fixed to the surface and comprises a guide section, and a hook section, wherein the loop is attached to or forms part of the tie, wherein the loop is retained by the guide hook, and wherein the loop and the tie are in tensile stress.

According to a further embodiment of the invention, the tensile structural assembly comprising a surface, a guide hook, a loop and a tie detailed above can be employed to apply even more tension to the tensile fabric in addition to the method as described hereinabove.

According to one embodiment of the invention, the first and second support members are hoops and are typically located in the top corners of a billboard surface.

According to another embodiment, the locking member is a ratchet hook. This is typically located in the bottom right hand corner of the billboard surface as viewed from the front and prevents the carrier member from moving when the tensile fabric is under tension, maintaining the desired level of tension.

According to another embodiment, the securing member is a fixing hook which is able to receive the bottom end of the carrier member. This is typically located in the bottom left hand corner of the billboard surface as viewed from the front.

According to another embodiment, the carrier members are poles to which the tensile fabric is attached. The pole which is engaged first with a support member is denoted as a cassette tension pole, while the pole engaged second is denoted as a take-up tension pole. The poster may be secured in any convenient and effective manner such as using adhesive or removable tape. Using removable tape allows the poster to be easily removed from the poles once it is no longer required so the poles can be re-used.

The tensile fabric may be any fabric which is durable under exposure to the elements and which has some elastic properties. Such fabrics include, but are not limited to, compositions comprising polyethylene. The fabric may be any size as required commensurate with the size of the billboard or other display means.

According to a further aspect of one or more embodiments of the present invention there is provided a tensile structural assembly comprising a surface, a guide hook, a loop and a tie, wherein the guide hook is fixed to the surface, the guide hook comprising a guide section and a hook section, wherein the loop is attached to or forms part of the tie, wherein the loop is retained by the guide hook, and wherein the loop and the tie are in tensile stress.

According to a further aspect of one or more embodiments of the invention, there is a method of assembling a tensile structural assembly comprising a surface, a guide hook, a loop and a tie, wherein the guide hook is fixed to the surface, the guide hook comprising a guide section and a hook section, wherein the loop is attached to or forms part of the tie, the loop being retained by the guide hook, and wherein the loop and the tie are in tensile stress, wherein the method uses an application tool comprising a recess, the method comprising the steps of:

(i) fixing the guide hook to the surface;

(ii) temporarily locating the loop in the application tool recess;

(iii) temporarily locating the application tool over the guide section; and (iv) applying a force to the application tool which moves the loop along the guide section imparting tension to the loop and the tie, until the loop is moved to the end of the hook section and snaps back within the hook section, retaining the loop and the tie in tension.

As a means of an example only, and in a non-limiting manner, the method of the invention will now be explained in terms of its application to billboards, although various embodiments of the invention can be used in a wide variety of tensile structures, of many optional structural forms and materials.

Conventional billboards can be seen everyday on the streets. There are many thousands of them in the UK alone. As mentioned above, it is still very common to see posters which have been pasted onto the billboard surface piece by piece, and the joins of the pieces are clearly visible.

The method of the invention can be used on such conventional billboards, and posters can be installed in front of the existing pasted-on posters.

The frame of the billboard is opened up, and the top of a carrier member at one end (usually, but not exclusively, the right hand end) of the poster is inserted through a first support member situated near the top corner of the surface of the billboard. The bottom end of the carrier member is equipped with a small U-rod which is placed in a U-shaped recess in a locking member situated vertically below the support member. The tensile fabric is then unravelled. The top end of the carrier member at the other end of the poster is inserted through a corresponding support member situated near the other top corner of the surface of the billboard, and the small U-rod at the bottom end is placed in a U-shaped recess in a securing member. The tensile fabric then has tension applied to it by the locking member.

Using the method of the invention, posters on billboards are clear and smooth in appearance, with no joins present which could be visible, unlike pasted on posters. The method takes in total about 3½ minutes, in contrast to the 20 minutes needed for pasting posters to the billboard, and can be performed entirely from ground level and hence does not require the use of any ladders or safety equipment.

According to another embodiment of the method of assembling a tensile fabric arrangement, the tensile fabric may be further tensioned. This can be achieved by using the tensile structural assembly comprising a surface, a guide hook, a loop and a tie as described above. Usually, the tensile fabric is attached in two, three or four places both at the top and at the bottom of the tensile fabric to the surface; although as many or as few guide hooks and loops to retain the tie in tension may be used as required by the size of the fabric.

The tie is optionally a membrane tie comprising a sheet of fabric or filmic material or a linear tie, for example string, rope, or an elasticated cable.

Typically, the guide hook serves as a guide to the application tool or to a fixture attached to the loop or the tie. The guide hook usually comprises a substantially linear guide section of substantially uniform cross-section and is fixed to a base structure, for example is screwed or bolted to a billboard structure or a building structure, such as to a brick wall, or to a compression member, such as a strut in a space structure, or a pole, such as a flag pole. The guide hook is typically metallic, for example of steel, stainless steel, aluminium or brass, although it can be made of any other sufficiently rigid and durable material, such as moulded plastic.

The application tool typically comprises two forked prongs, to be placed on either side of the guide section of the guide hook. The end of each prong of the tool typically comprises a recess into which the loop is temporarily located during the assembly process. The prongs of the tool may be retained in an application tool shaft or handle, which is optionally extended by means of a pole, which can be attached to the handle, for example by means of a sleeve screw or bayonet fixing, such as the tool handle comprising a sleeve into which the pole or an end fitting to the pole fits when it is required to extend the length of the application tool.

Typically, the guide section comprises a length of substantially uniform width, although it may be of any convenient width to correspond with the spacing of the prongs of the application tool.

Optionally, a fabric or filmic membrane tie will have elastic properties, for example fabric comprising rubber elastic threads. Optionally, a fabric or filmic structure will have reinforced edges, such as a seam, optionally containing a cable.

A membrane tie typically comprises discrete fixing points, for example eyelet holes or gripper devices, e.g. holdon™ two component grippers, one of the components being a wedge.

Typically, each loop in an assembly comprises a highly elastic cord, sometimes referred to as a "shock cord" or "bungee cord", as this imparts additional advantages to one or more embodiments of the invention, for example a positive "snap back" feature when being located over the end of a guide hook, accompanied by a distinctive noise which indicates that the required tensile fixing of the loop over the guide hook has been properly effected. The application tool is simultaneously released on snap back. The snap back noise is created by the laterally curved outer profile of the hook section stretching the elastic cable of the loop away from the recess in the guide hook, the elastic cable snapping back when reaching the end of the hook section, the elastic cable and/or the application tool being thrown against the surface or a part of the guide hook. The snap back noise is often clearly discernible against background noise such as passing vehicular traffic. Optionally, a "sounding device", for example a thin piece of metal, forms part of or is attached to the surface or guide hook, to increase and further distinguish the snap back noise, such as a relatively high pitched noise against the lower pitched drone of passing traffic on a highway to which a billboard is adjacent.

In an embodiment of the invention, a billboard tensile structure comprises a plurality of guide hooks fixed to a planar billboard structure, for example metallic hooks screwed to a timber or metal-faced timber sheet to which printed billboard paper posters are otherwise applied. An elasticated loop is typically located over each hook guide, so tensioning a fabric or filmic membrane tie which is typically printed, for example polyethylene fabric printed with UV-cured ink, or PVC-coated polyester fabric printed with solvent or UV-cured ink. A poster can be fixed to the billboard according to the method of the invention, and optionally further tensioned in this way.

The sequential fixing of tensile connection points is normally problematic. For example, if an initial number of connecting points are secured with a membrane tie in a slack condition, the required tension needs to be imparted into the membrane tie and all the discrete tensile connections when forming the residual tensile connections. The residual connections typically could not be made from a remote access position, as an application tool on a pole has minimal lateral stability. The invention enables the membrane tie to be temporarily placed in a relatively untensioned or slack condition onto the guide hook, when the required force can be applied in a controlled member not requiring any lateral restraint to be imposed by the application tool or pole, which only requires an axial force to be applied.

The guide section of the guide hook and the two-pronged application tool work together with the loop, typically enabling a much greater force to be applied to the loop to fix it over the hook section of the guide hook, with much higher residual tensile forces in the loop and tie than provided by existing methods of fixing loops to restraining hooks. Optionally, when the loop is progressively pushed with the application tool along the guide section of the guide hook, the tension in the loop draws the two prongs into direct contact with the side of the guide section, providing the prongs can be so deflected, for example being unconnected at their ends and relatively flexible.

The guide section eliminates the tendency of the end of an application tool to be laterally unstable, especially if affixed to the end of a pole. Stability in the direction perpendicular to the surface is provided by the angle of the application tool against the guide section or the surface to which the guide hook is fixed. Optionally, stability in this direction can be additionally provided by a recessed groove on one side or preferably both sides of the guide section of the guide hook, for example the guide section being a 'T' section or comprising a recess on each side or a section of the similar shape to a railway rail, into which lugs on the application tool are located. Optionally, the end of the guide section of the hook is tapered, to assist the initial locating of the application tool onto the guide section of the guide hook. Typically, the longitudinal axis of the guide hook is aligned or orientated to allow an axial force to be applied to the handle of the application tool or any extension pole, from an access position below the billboard. Optionally, a swivel or rotational capability can be incorporated into the end of the application tool, for example by means of a universal or ball joint, to enable a loop to be located over a guide hook by a force applied from a position which is not aligned with the longitudinal axis of the guide hook.

The tensile fabric arrangements of one or more embodiments of the invention are typically temporary, for example comprising frequently replaced billboard advertisements, or temporary shelters or temporary flags or banners. In the embodiment where further tension of the tensile fabric is desired, to release a loop from a guide hook, in dismantling a structure, one of the application tool prongs is placed between one side of the loop and guide section of the hook and pushed towards the hook section until the loop is released. Preferably a purpose-made release tool is used, typically comprising an axial single prong with a single recess to support the loop cable.

Optionally, a projecting support is provided on the surface to eliminate or reduce flapping of the membrane tie, for example under windy conditions. The projecting support optionally has a surface of single or double curvature and is optionally a solid support, for example comprising a foam material, or is optionally a framework, such as a lattice of timber members, or optionally comprises discreet support positions, for such as discreet hemispherical projections from the base support. Optionally the projecting support comprises a transparent surface behind which illumination is provided, for example to provide a back-lit illuminated billboard sign on a billboard structure that was previously not illuminated.

Additional and/or alternative advantages and salient features of the invention will become apparent from the following detailed description, which, taken in conjunction with the annexed drawings, disclose preferred embodiments of the invention.

Reference is made to the following Figures, which are intended to be illustrative only and in no way limiting upon the scope of the invention.

FIGS. 11A-D show elevations of application tools.

FIGS. 12A-E show sequential diagrams showing the application of a loop attached to a membrane tie over a guide hook in side elevation.

FIGS. 13A-F show sequential diagrams showing the application of a loop attached to a membrane tie over a guide hook in front elevation.

Figure 14:
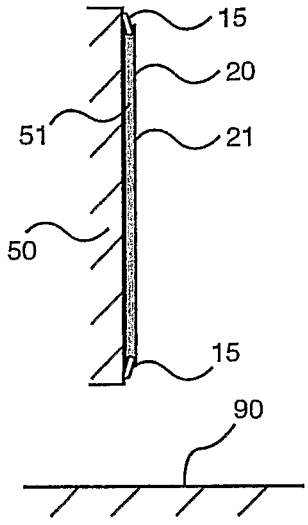

FIG. 14 shows a cross-section through a billboard structure comprising a projecting support.

Figure 15:
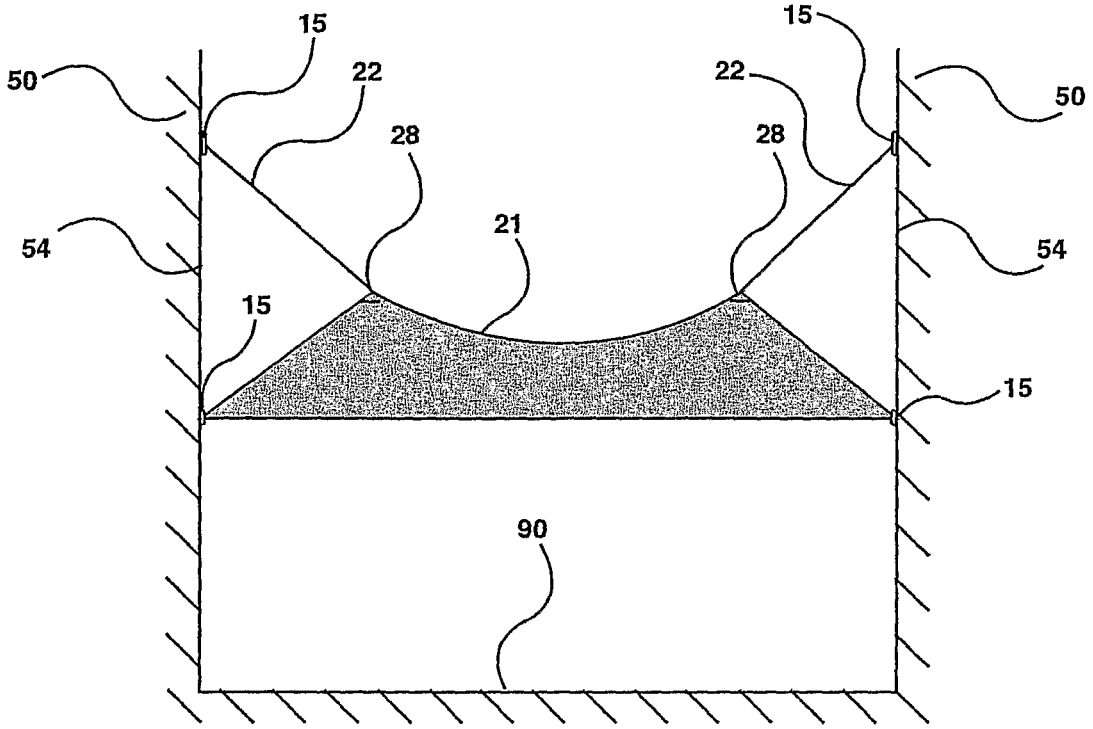

FIG. 15 shows an elevation of a tensile structure canopy between two buildings.

Figure 16:
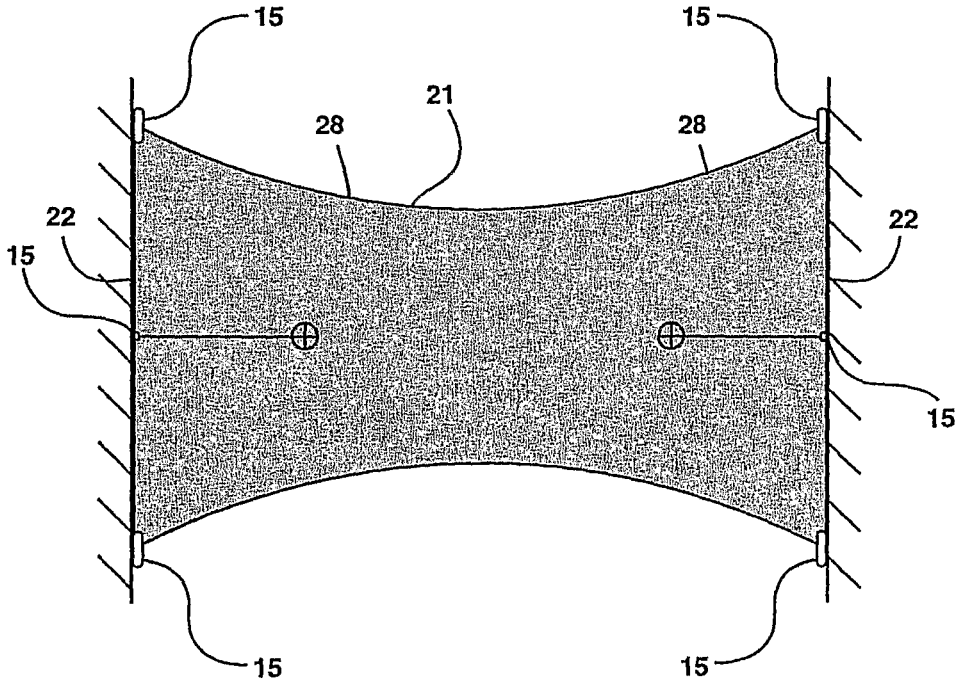

FIG. 16 shows a plan of a tensile structure canopy between two buildings.

Figure 17:
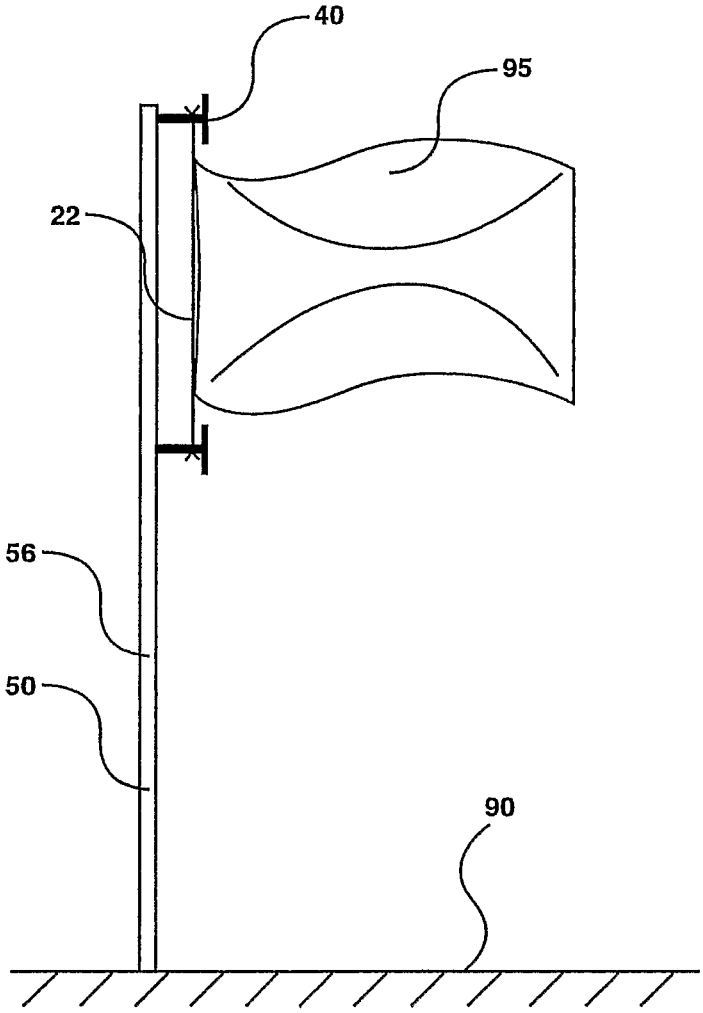

FIG. 17 shows an elevation of a flag-pole structure.

Figure 18A:
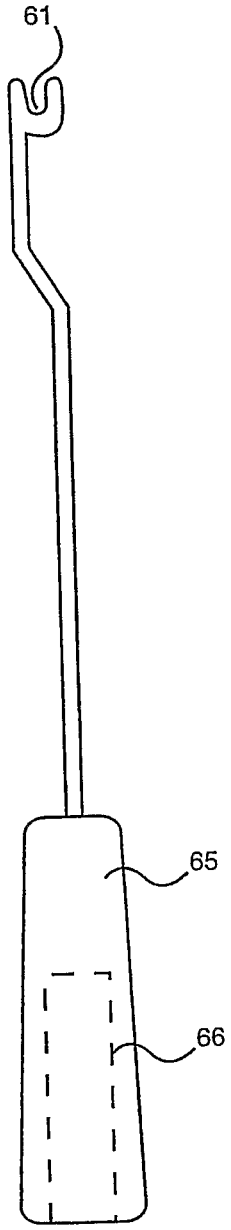
Figure 18B:
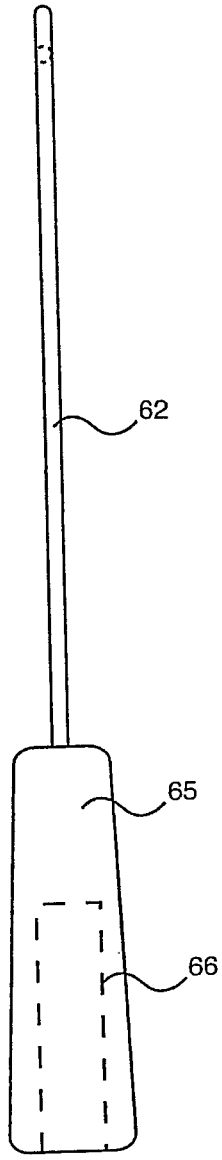

FIGS. 18A and 18B show elevations of a removal tool.

Figure 19:
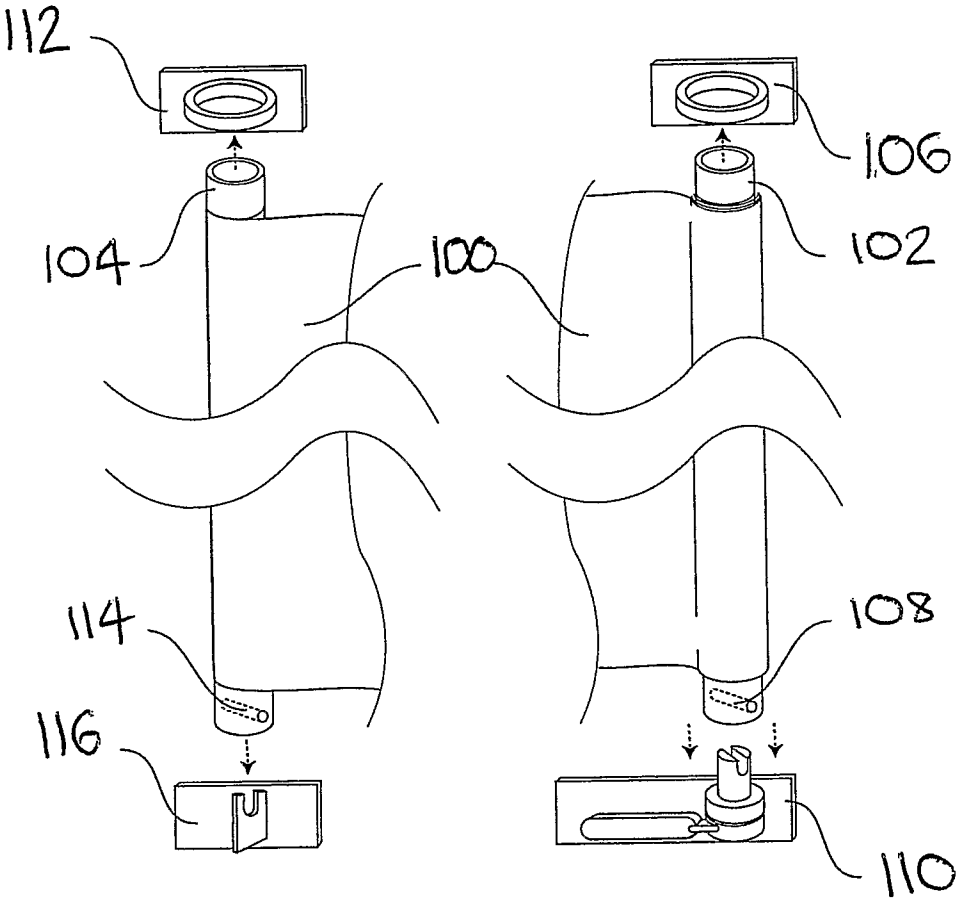

FIG. 19 shows a view of the hoops, fixing hook and ratchet hook arrangement used.

Figure 20B:
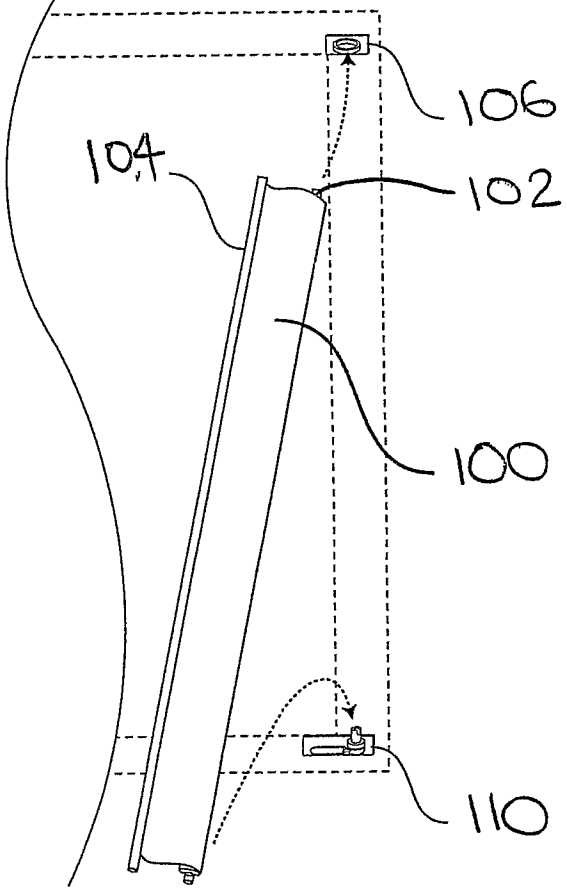
Figure 20A:
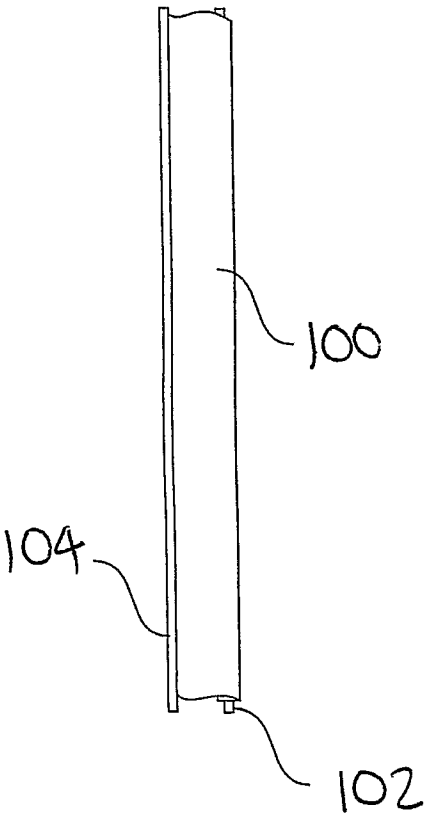

FIG. 20A shows an elevation of a poster rolled onto a cassette tension pole and fixed to a take-up tension pole.

FIG. 20B shows an elevation of a poster and a cassette tension pole being engaged with a hoop and fitted on to a ratchet hook.

Figure 21:
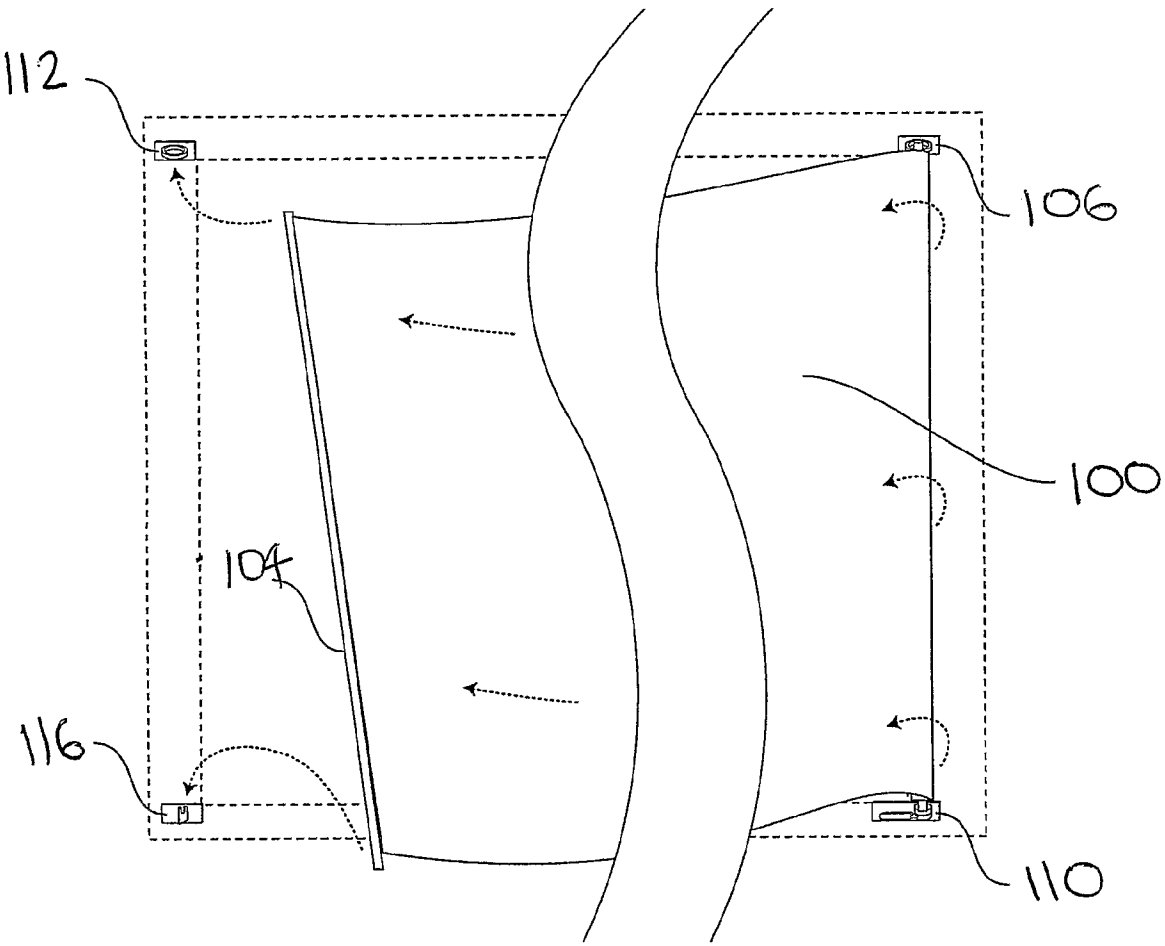

FIG. 21 shows an elevation of a poster and a take-up tension pole being engaged with a hoop and fitted on to a fixing hook.

Figure 22:
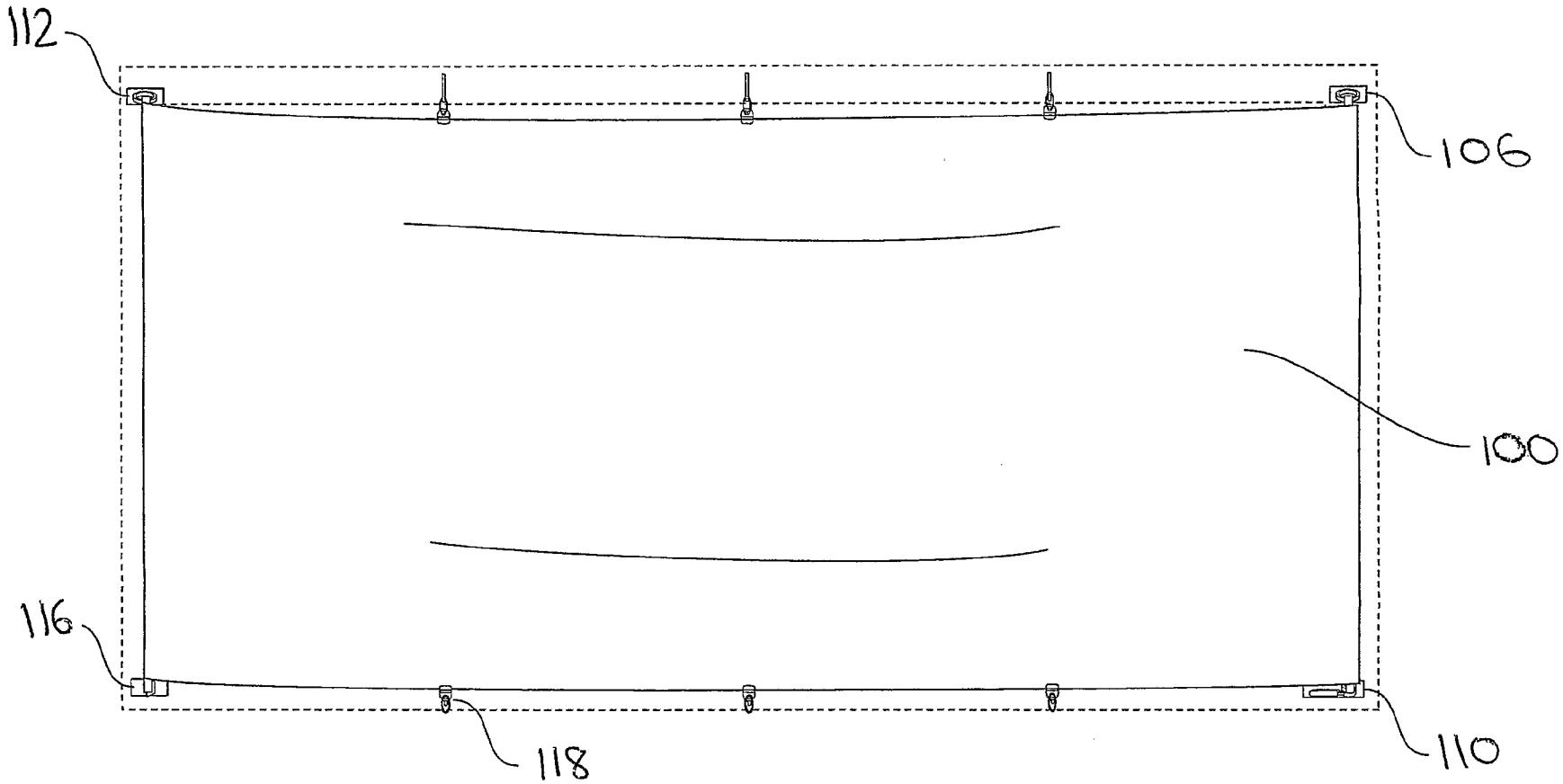

FIG. 22 shows an elevation of a poster being partly stretched and fixing bungee clips applied on to the hooks.

Figure 23:
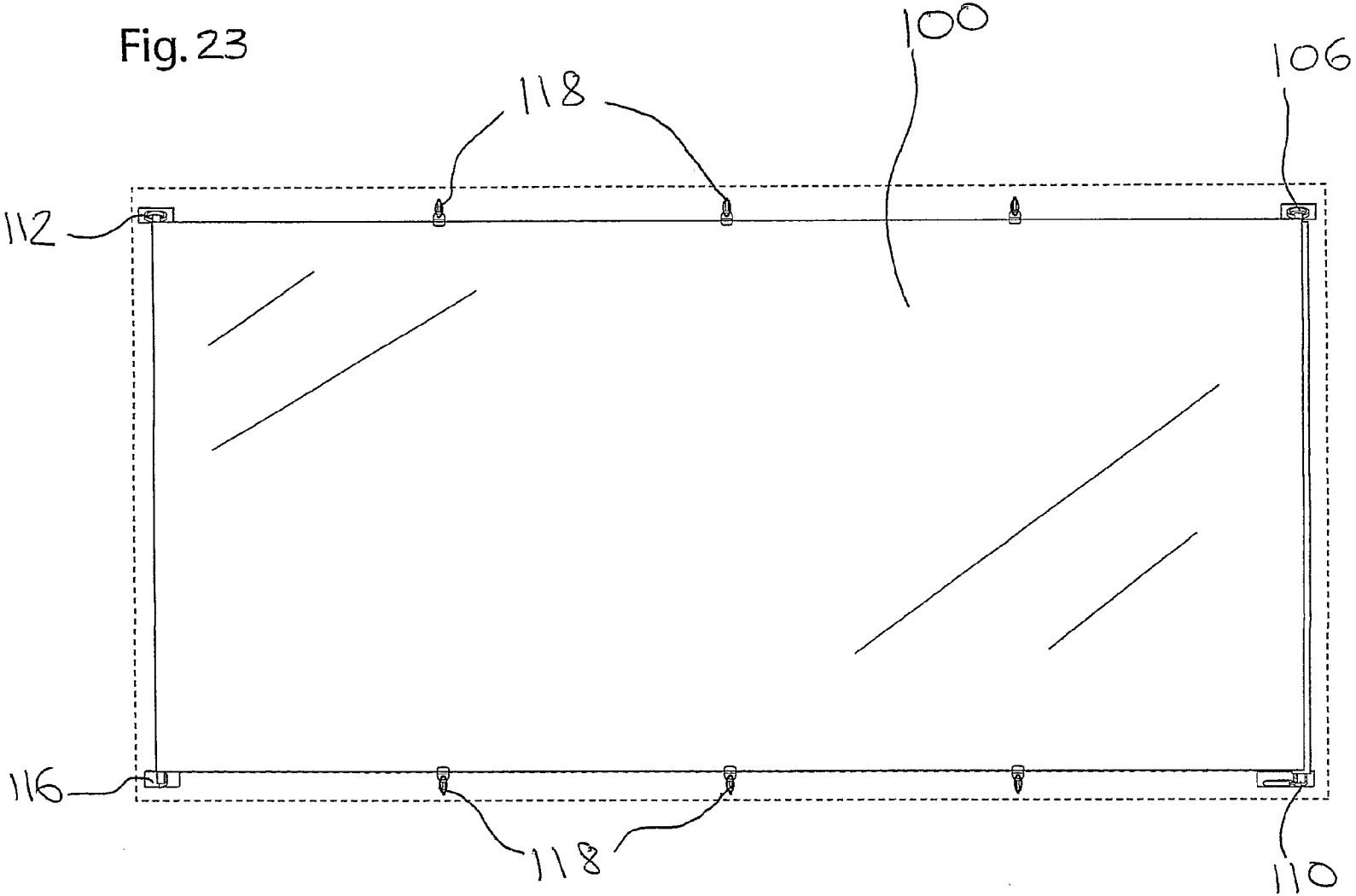

FIG. 23 shows an elevation of a poster in a fully tensioned state.

Figure 1:
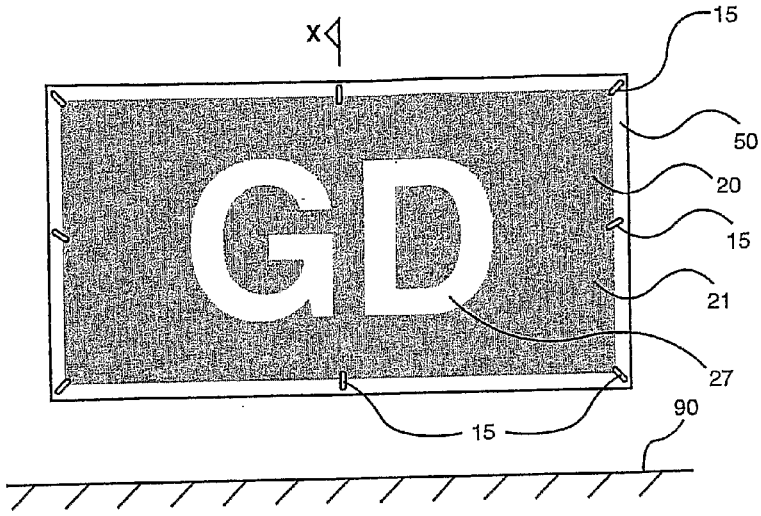
FIG. 1 shows an elevation of a billboard structure.
Figure 2:
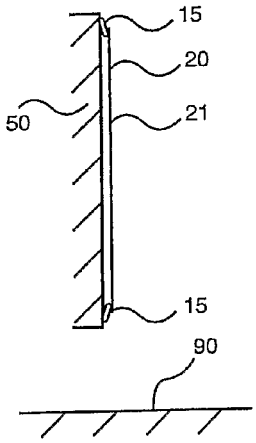
FIG. 2 shows a cross-section through the billboard structure of FIG. 1.

FIG. 1 is a general elevation of a billboard tensile structure comprising surface 50 with tie 20, being a membrane tie 21 comprising graphic design 27 fixed to the surface 50 by means of discrete connections 15, which may be effected from access area 90, as also shown in cross-section in FIG. 2.

Figure 3:
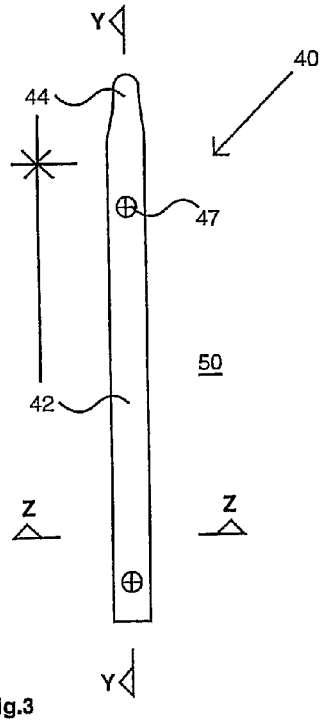
FIG. 3 shows an elevation of a guide hook.
Figure 4:
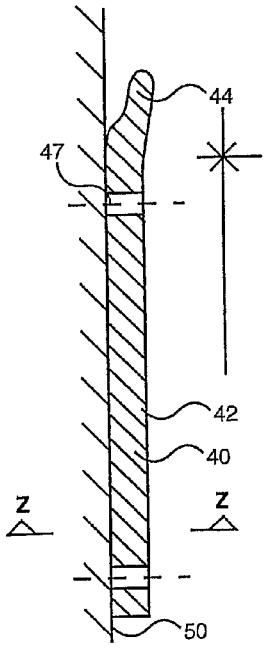
FIGS. 4 and 5 show longitudinal cross-sections through guide hooks.
Figure 5:
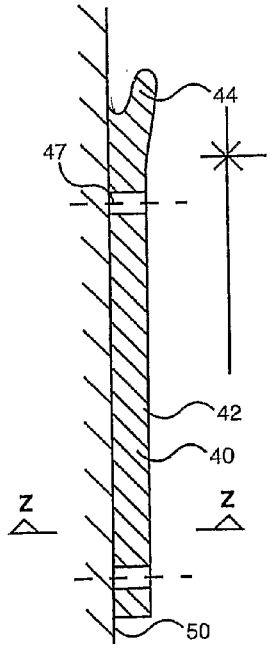

The discrete connections 15 comprise a guide hook 40, shown in FIG. 3, fixed to surface 50 through screw holes 47. In FIG. 3, the guide hook 40 comprises a guide section 42, typically of substantially uniform cross-section, and a hook section 44. The guide hook 40 is also illustrated in cross-section Y-Y in FIGS. 4 and 5.

Figure 6:
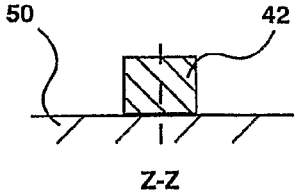
FIG. 6 shows a cross-section through a guide hook profile.

FIG. 6 is an example of a rectangular cross-section of the guide section 42 of the guide hook 40.

Figure 7:
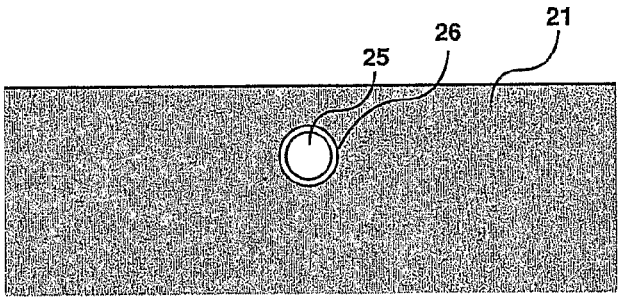
FIG. 7 shows an elevation of an eyelet hole in a membrane tie.
Figure 8:
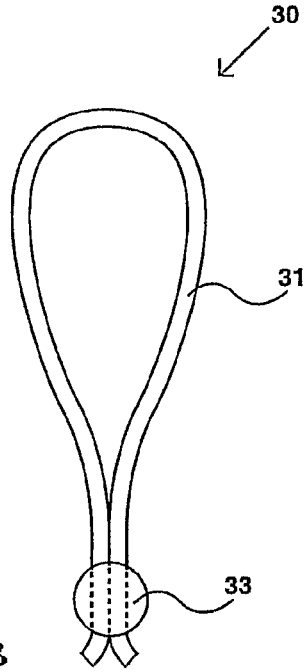
FIG. 8 shows an elevation of a loop.
Figure 9:
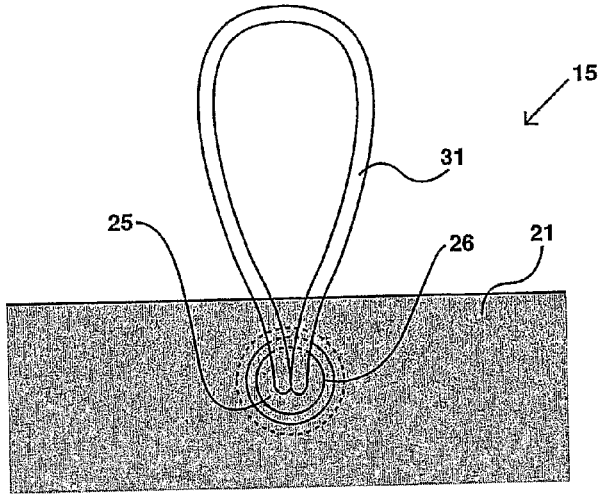
FIG. 9 shows an elevation of a loop located in an eyelet hole.

FIG. 7 illustrates fabric or filmic membrane tie 21 with an eyelet hole 25, typically with a metal annular or "ring" reinforcement 26, through which optional loop 30 in FIG. 8 is positioned and restrained at 33, for example as a bobble, as shown in FIG. 9. Preferably, loop 30 comprises elastic cord 31, sometimes referred to as a shock cord or bungee cord.

The membrane tie 21 has significant elastic properties itself and eyelet hole 25 comprises the loop according to an alternative embodiment of the invention.

Figure 10A:
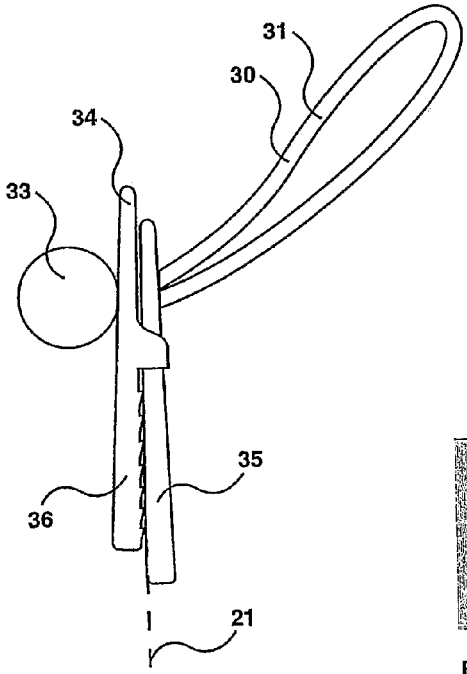
FIG. 10A shows a cross-section through a membrane gripper.
Figure 10B:
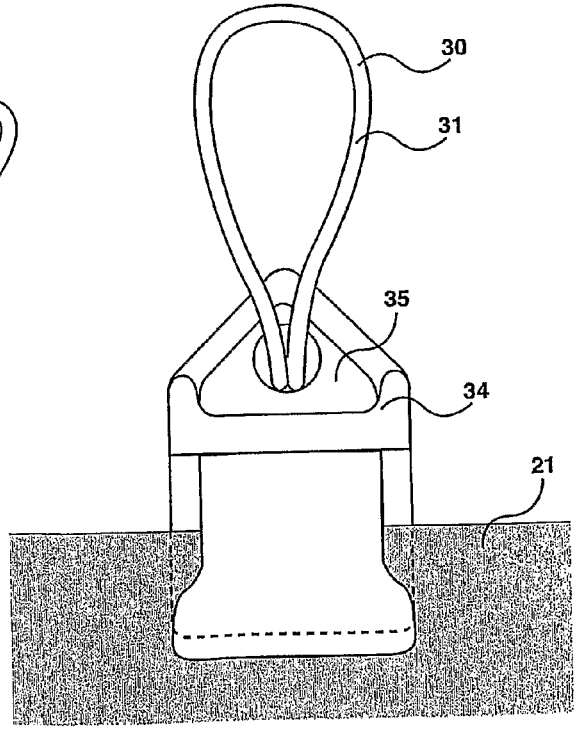
FIG. 10B shows an elevation of a membrane gripper attached to a membrane tie.

As another example of a discrete connection, FIG. 10A illustrates loop 30 passing through holes in a gripper 34, comprising wedge section 35 and holding section 36, (which is optionally serrated) for example a holdon™ gripper supplied by holdon™, which grips membrane tie 21, as also illustrated in FIG. 10B, The holes in wedge section 35 and holding section 36 are offset so that tensioning of loop 30 imparts an increased wedging force of wedge section 35 onto the trapped membrane tie 21.

Figure 11A:
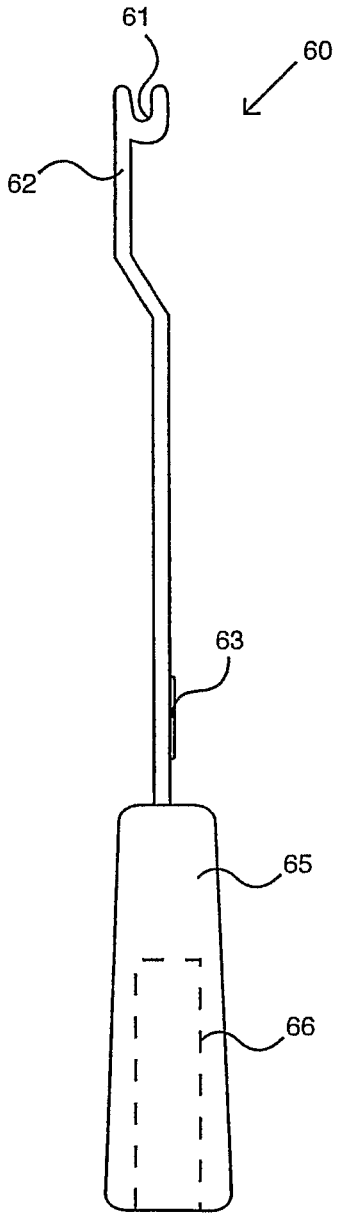

FIG. 11A illustrates an application tool 60 manufactured primarily from steel rod (or any other suitable material such as other metals or a rigid plastic material). The prongs 62 each comprise a recess 61 in which the loop sits during the application process. The prongs 62 comprise a bridge 63 and are also bridged towards the end of the prongs (not shown). Handle 65 comprises recess 66, for example for a screw or bayonet fixing to an extension pole (not shown), to enable remote fixing of a loop over a guide hook.

Figure 11B:
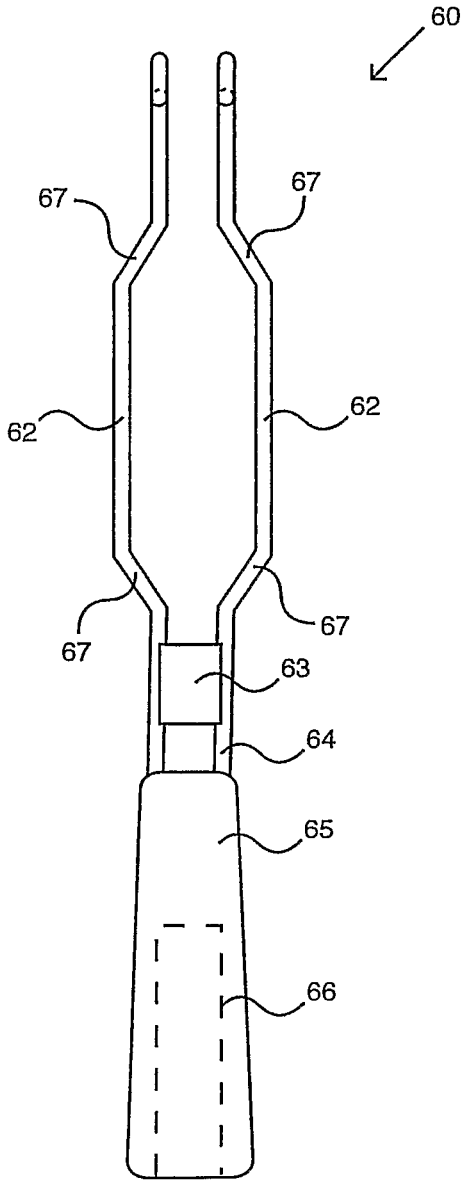

FIG. 11B is a front elevation of the same application tool 60 as FIG. 11A, showing splayed portions 67 of prongs 62, which enable the application tool to straddle a wide range of fixing devices during the application process.

Figure 11C:
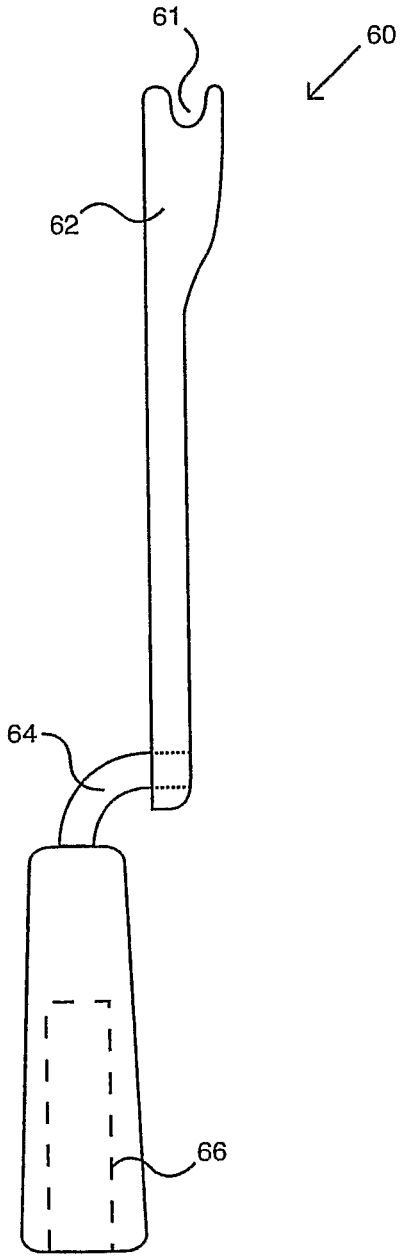
Figure 11D:
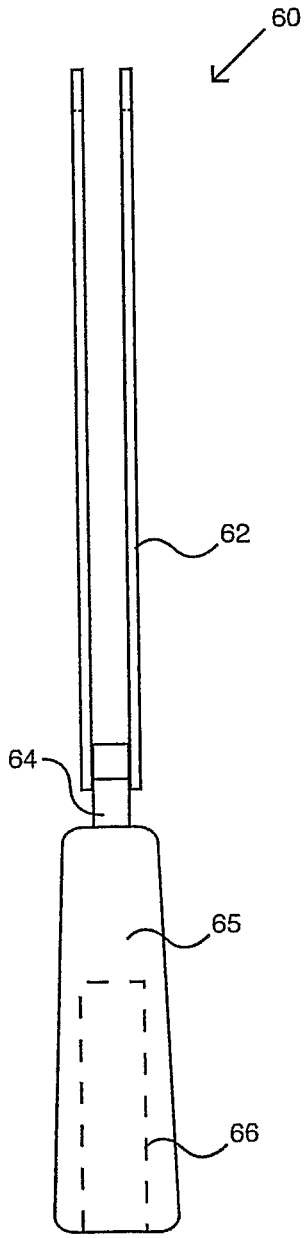

FIGS. 11C and 11D are side and front elevations of a different application tool 60 comprising prongs 62, each comprising a recess 61 and joined by shaft 64, for example by welding. Depending on the height of the access area in relation to individual discrete connections in the tensile structure assembly, application tools of alternative design or layout may be provided, for example if the lower edge of a billboard tensile structure is above head height from the access area, the recess 61 of the application tool, in fixing the lower connections, may be downward facing, to enable a pulling action to be adopted rather than a pushing action.

Figure 12A:
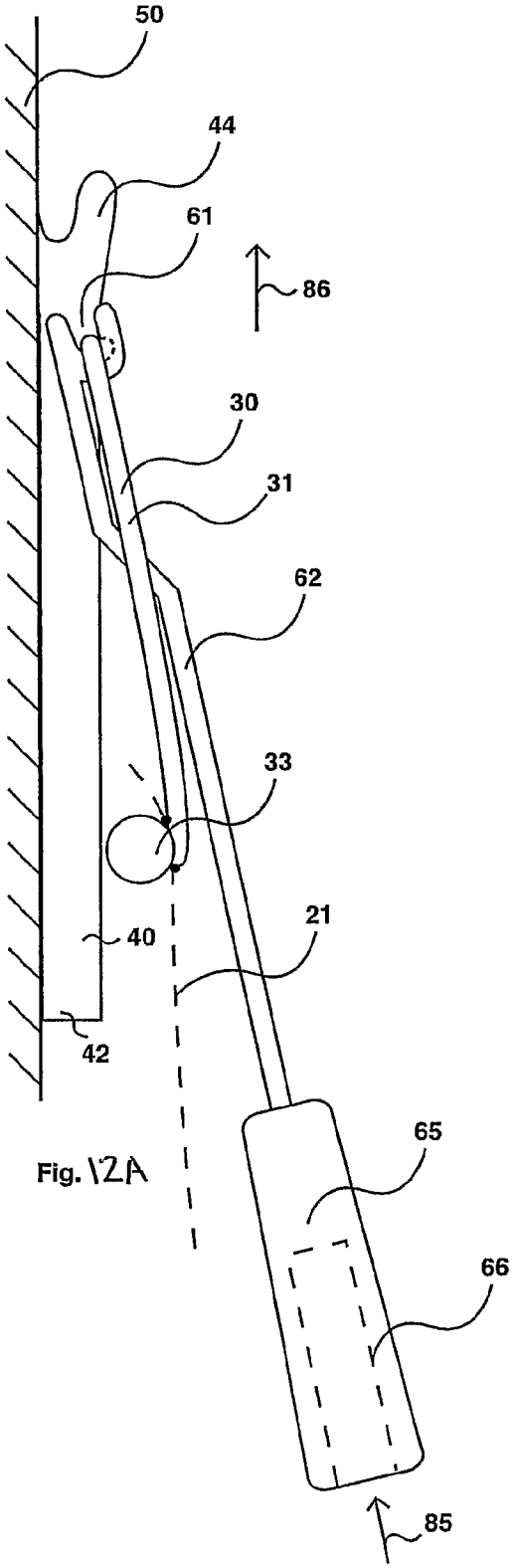
Figure 12B:
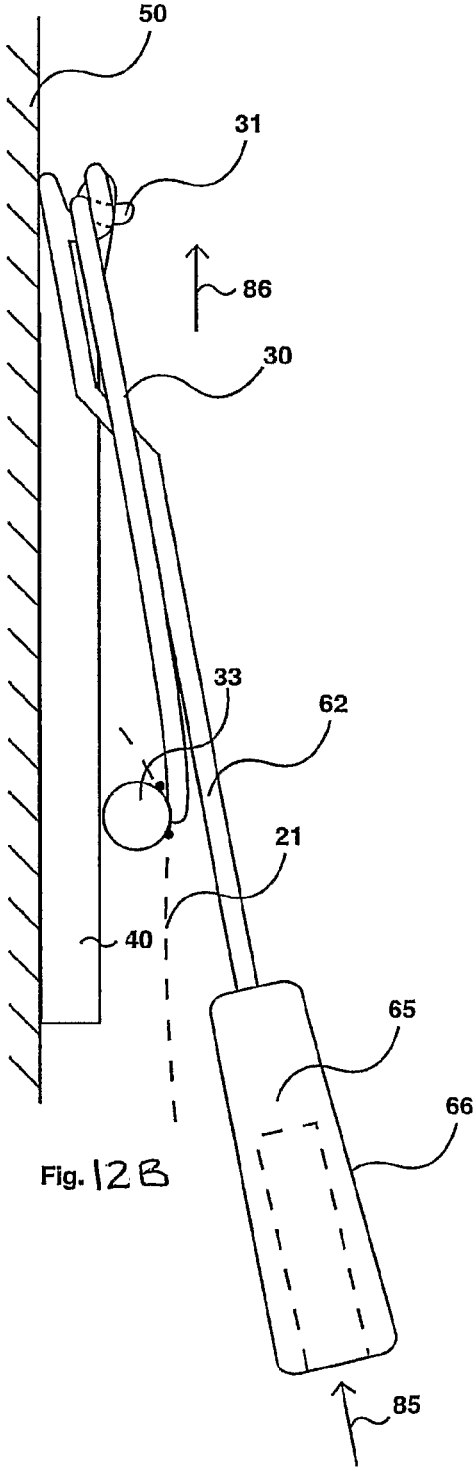
Figure 12C:
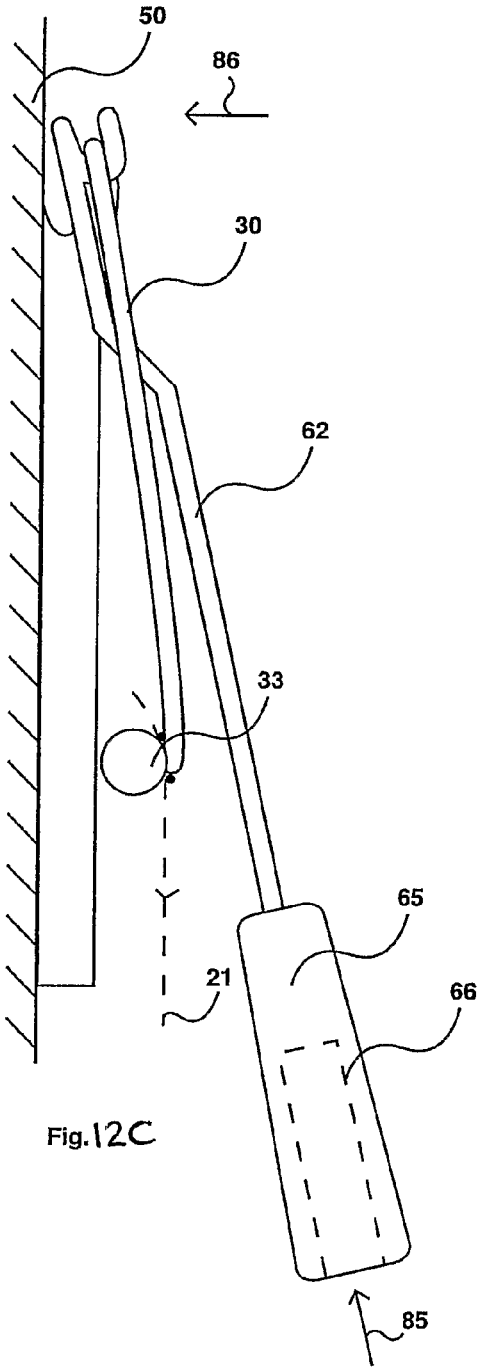
Figure 12D:
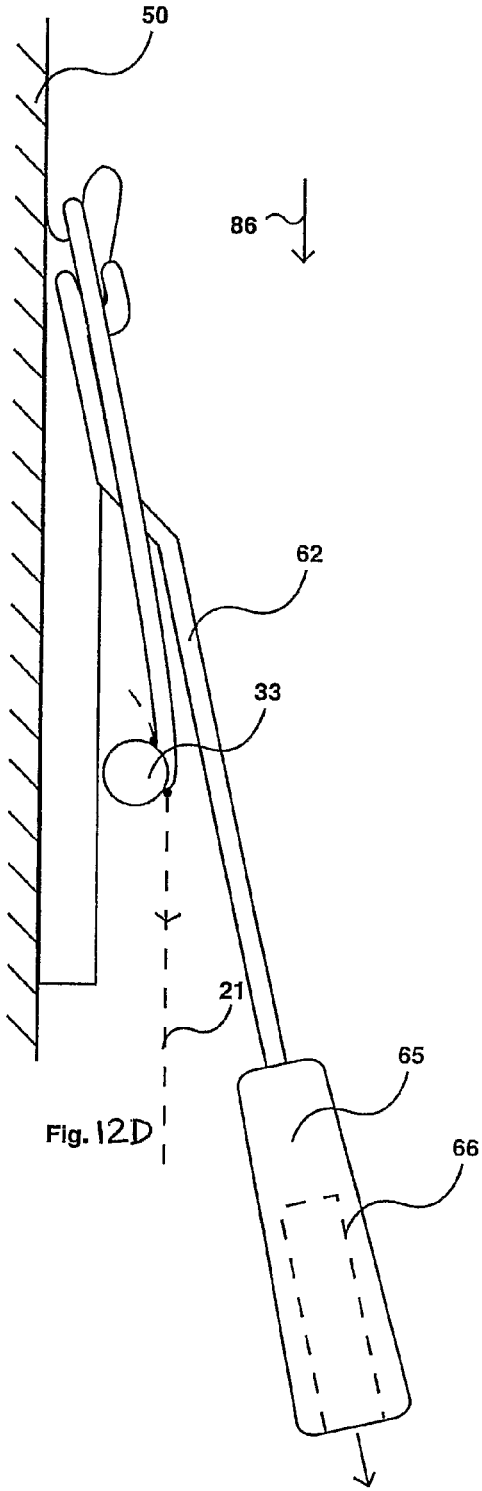
Figure 12E:
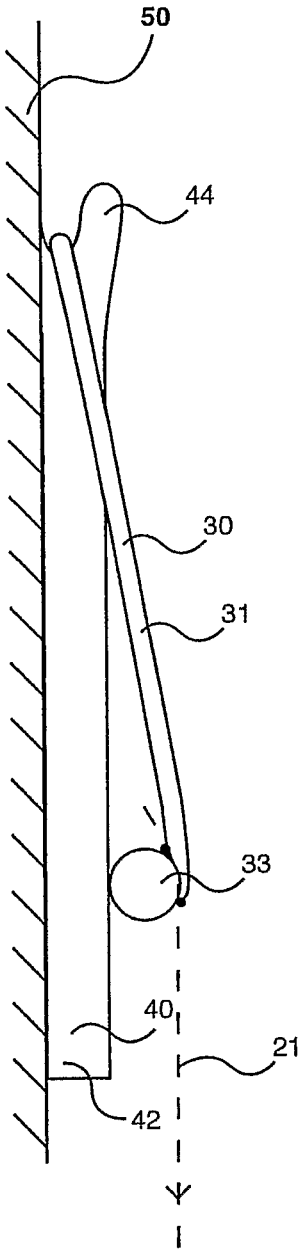

FIGS. 12A-E illustrate the tensioning and application of loop 30 to guide hook 40 fixed to surface 50 after the loop 30 has been located within the recess 61 of prongs 62 and prongs 62 have been located to either side of guide section 42 of guide hook 40. A substantially axial force 85 applied to handle 65, either directly by hand or via an extension pole (not shown), pushes the elastic loop along the guide section 42 in direction 86 in FIG. 12A, and onto the outside of the hook section 44, in FIG. 12B, in which elastic cord 31 is shown stretched sideways away from prong recess 61, the end of prongs 62 bearing against surface 50. In FIG. 12C, further upward movement in direction 86 causes the loop 30 to reach the top of hook section 44, when the ends of prongs 62 are forced away from surface 50 until the elastic cord snaps back towards surface 50 in direction 86. The snapping action of the elastic cord 31, akin to the action of a catapult, throws the prongs 62 against the surface 50 making a distinctive noise by virtue of the release of this elastic energy, including the noise of impact of prongs 62 against surface 50. This snap back feature of the invention assists the postitive location of loop 30 around hook section 44 and simultaneously releases the application tool from the guide hook as shown in FIGS. 12D. FIG. 12E shows the complete installation of loop 30 to guide hook 40, elastic cord 31 and membrane tie 21 being in tension.

Figure 13A:
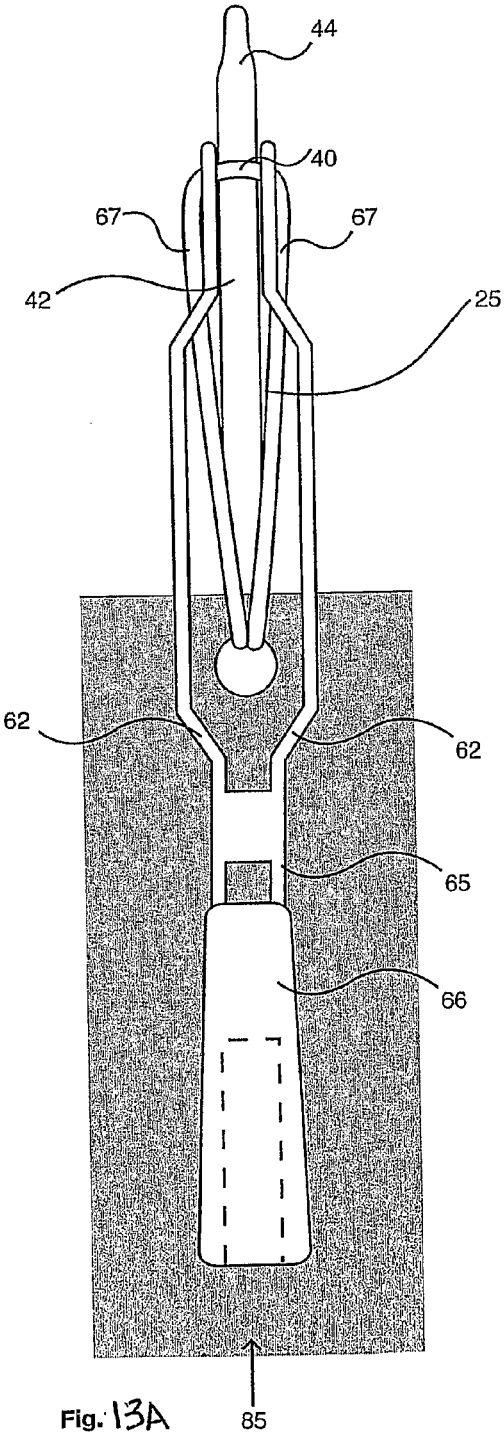
Figure 13B:
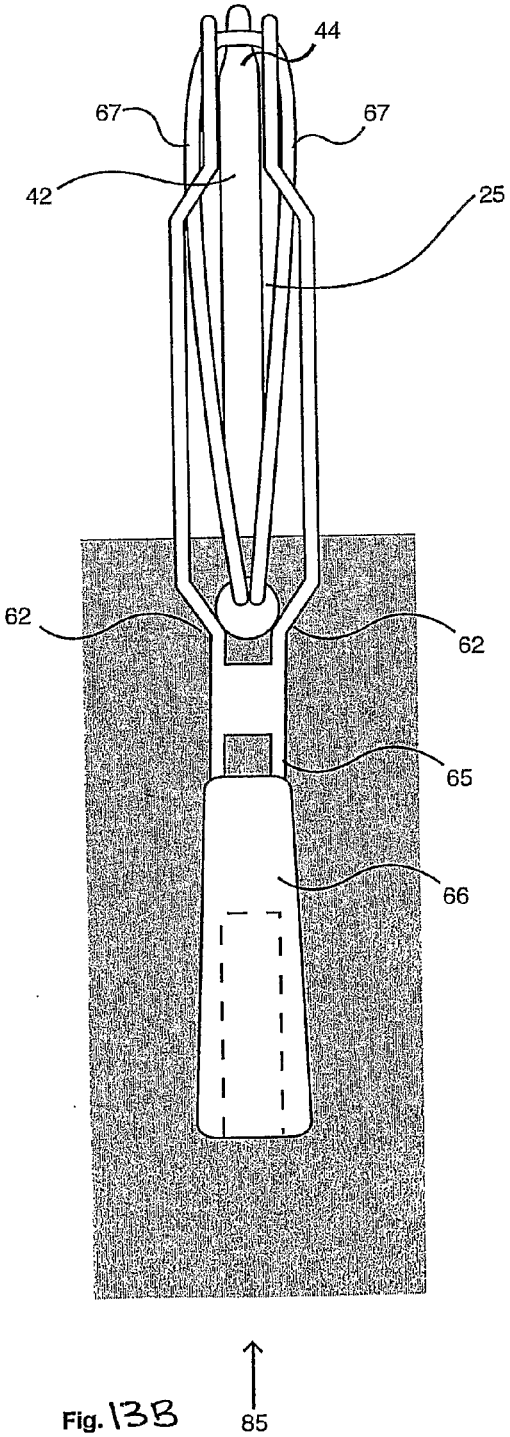
Figure 13C:
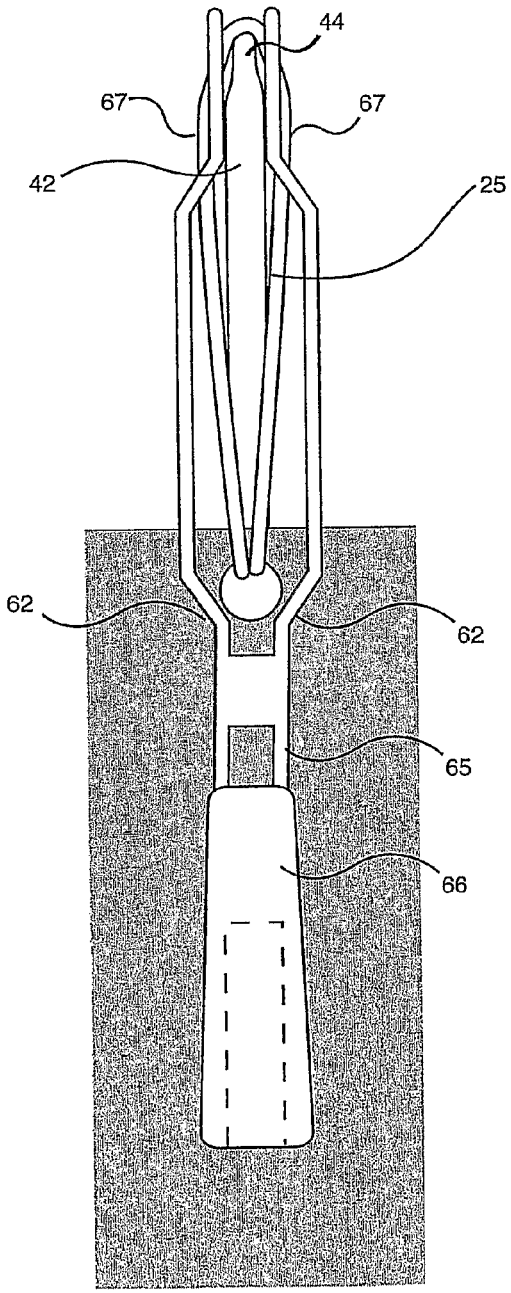
Figure 13D:
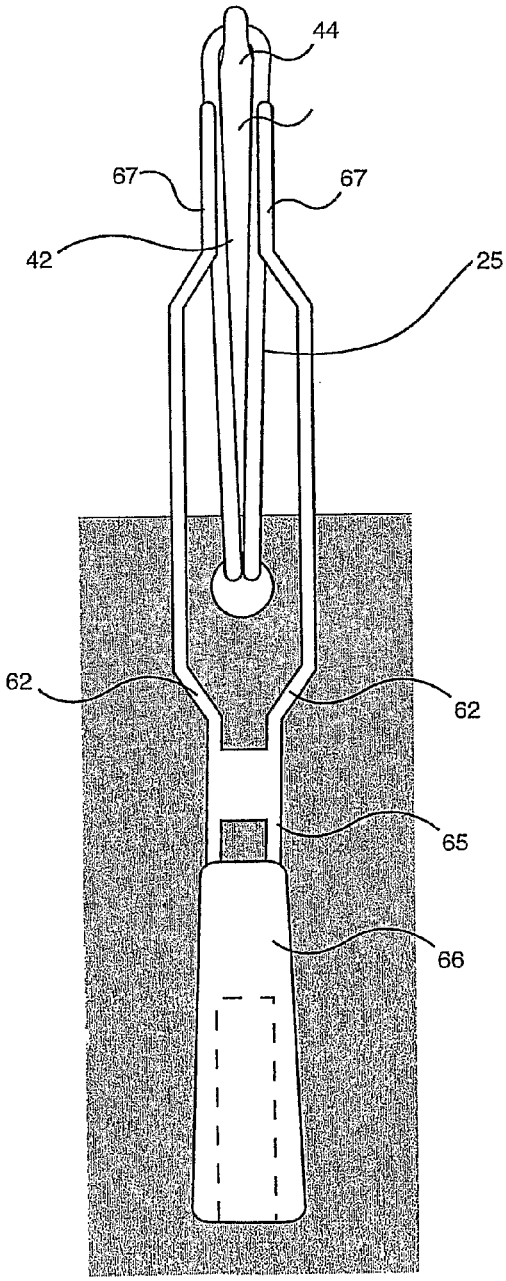
Figure 13E:
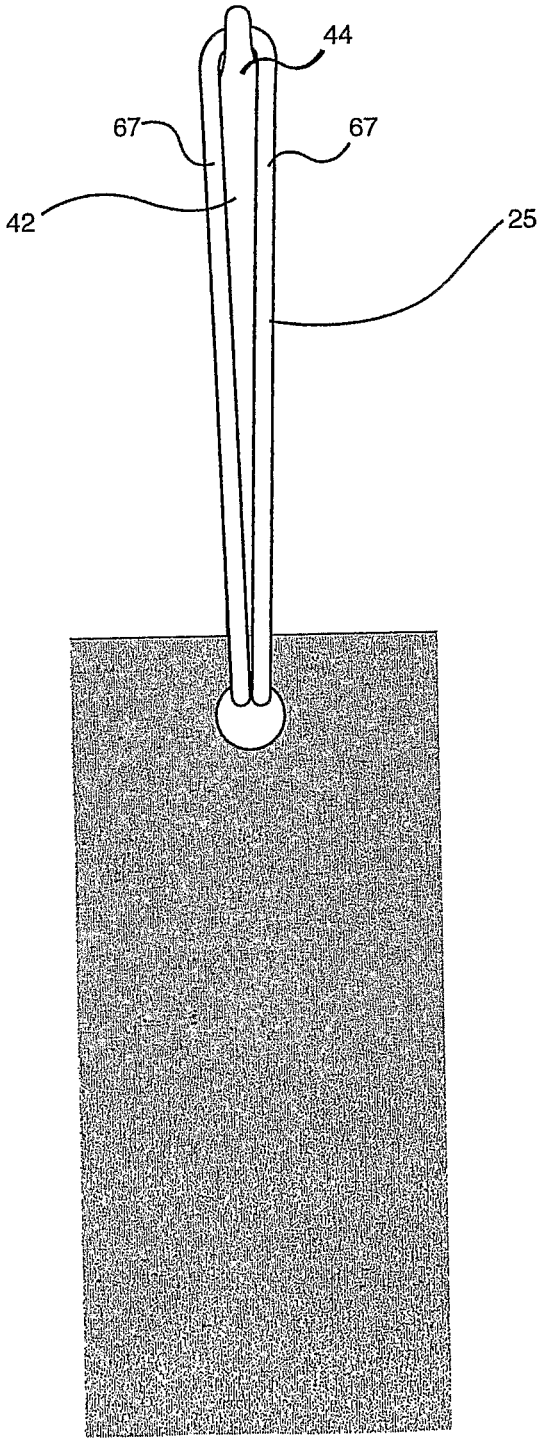
Figure 13F:
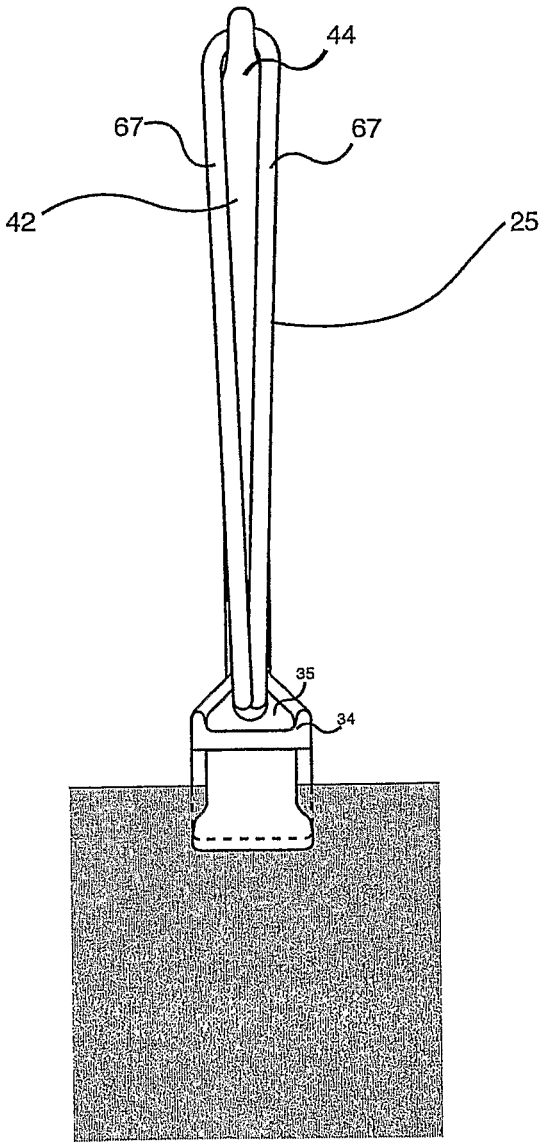

FIGS. 13A-13E depict the same operation as FIGS. 12A-12E, but in a front elevation, with FIG. 13F showing the finished supported tensile fabric.

FIG. 14 is a cross-section through a billboard tensile structure similar to FIG. 2 but comprising projecting support 51 located between surface 50 and membrane tie 21, to assist the provision of a smooth surface to membrane tie 21 and reduce any tendency of membrane tie 21 to flap, for example under wind loading. Projecting support 51 is of single curvature or double curvature, the latter requiring a membrane tie with sufficient elastic or plastic deformation properties to accommodate the double curvature. The projecting support 51 is a solid support, such as one comprising a foam material, or is a framework, such as a lattice of timber members, or comprises discrete support positions, such as discrete hemispherical projections from the base structure. The projecting support comprises a transparent surface behind which illumination is provided, for example to provide a back-lit illuminated billboard sign on an existing billboard structure that was previously not illuminated. A surrounding frame can be provided to mask the discrete connections 15 and projecting support edges.

FIGS. 15 and 16 show a canopy tensile structure comprising membrane tie 21 covering an access area 90 between buildings 54 comprising wall surfaces 50. Membrane tie 21, for example of Teflon or PVC-coated polyester fabric, is fabricated by methods known in the art of tensile structures, into a double curvature shape to be tensioned to form a stable structure. The membrane tie 21 and linear ties 22 are connected to surface 50 by means of discrete connections 15. Linear ties 22 are also connected to membrane tie 21 at reinforced connectors 28 by constructional details known in the art of tensile structures. Such canopies are temporary, such as to cover a barbecue area, or semi-permanent, such as to provide a covered walkway between two buildings FIG. 17 illustrates a flag hoisting system comprising a flag 95, for example a conventional printed fabric flag, a flagpole 56, for example of timber or metal tube and comprising surface 50, a linear tie 22, for example elastic cord, and guide hook 40. Guide hook 40 is fixed directly to flagpole 56 or is on projecting arms, for example of steel or brass, or moulded plastic. Such projecting arms can be made the width of a membrane tie, for example forming a vertical banner attached to a street lamp pole.

Dismantling structures of the invention typically involves locating one prong of an application tool between the loop and guide hook and pushing the loop until disengaged from the guide hook. A purpose-made removal tool 80 can be used for this purpose, for example as illustrated in FIGS. 18A and 18B, comprising a single prong 62 with recess 61, handle 65 and recess 66 to enable an extension pole to be affixed.

FIG. 19 illustrates a view of the hoops, fixing hook and ratchet hook arrangement used in the method of assembling a tensile fabric arrangement according to the invention. A poster 100 has two ends which are attached to two hollow tension poles, a cassette tension pole 102 and a take-up tension pole 104. The top of the cassette tension pole 102 is inserted through a hoop 106 situated near the top right hand corner (as viewed from the front) of the billboard surface. The pole 102 is then lowered and a U-rod 108 located near the bottom of the pole 102 is able to be inserted into a U-shaped recess in ratchet hook 110 located directly below hoop 106. Poster 100 is fully unravelled from the cassette tension pole 102. The take-up tension pole 104 is then inserted through a hoop 112 situated near the top left hand corner of the billboard surface. The pole 102 is then lowered and a U-rod 114 located near the bottom of the pole 104 is able to be inserted into a U-shaped recess in a fixing hook 116. Once the poles are in place, the ratchet hook is adjusted to provide tension to the poster fabric.

FIG. 20A illustrates a poster 100 rolled onto a cassette tension pole 102 and attached to a take-up tension pole 104 using removable tape. The poster 100 is pre-prepared in this manner before fitting it to billboard.

In FIG. 20B, a cassette tension pole 102 is moved upwards so that the top of it extends through hoop 106. Once done, the pole 102 is moved downwards in order that its U-rod 108 (not shown) may be inserted into the U-shaped recess in the ratchet hook 110. This corresponds to steps (i) and (ii) of the method of the invention as described above.

FIG. 21 illustrates steps (iii)-(v) of the method. The poster 100 is unravelled from the cassette tension pole 102 until the poster is fully extended. The take-up tension pole 104 is moved upwards so that the top of it extends through hoop 112, and once done, pole 104 is moved downwards in order that its U-rod 114 (not shown) may be inserted into the U-shaped recess in the fixing hook 116.

The poster 100 is tensioned by rotation of the ratchet hook 110. FIG. 22 illustrates a poster 100 in this manner. If desired, the poster 100 may be further tensioned by fixing bungee clips 118 to the poster 100, which bungee clips 118 are attached to the guide hooks (not shown) via the loop and tie arrangement. Three such bungee clips 118 are attached both at the top and at the bottom of the poster 100.

FIG. 23 shows the poster 100 in a fully tensioned state after it has been stretched using the ratchet hook 110 to its optimum profile to eliminate any unevenness.

Guide hooks are typically of relatively short length, for example from about 2 to about 12 inches (about 50 to about 300 mm). However, they can be of any length to suit the degree of convenience required in locating the application tool over the guide section, for example they may run the full height of a flagpole or billboard, for example using a progressively extendable pole, for example a telescopic pole, for ease of transporting application tools.

One or more embodiments of the invention reduce the risk of finger trap injury of manual application of loops to hooks while substantial tensile forces are being manually resisted.

One or more embodiments of the invention also enable loops to be applied to guide hooks in positions remote from erector access positions, for example billboards can be posted from an access area at ground level or on an access platform immediately below a billboard without requiring ladder access. Ladders can be a safety risk to erectors, especially when applying a substantial force, for example to effect a tensile connection when supported on a ladder rung. Similarly, canopy tensile structures can be erected from ground level, for example affixed to guide hooks on a building or buildings, for example to provide an infill walkway canopy between two buildings. As another example, flags and banners can be fixed to poles with shock or bungee cord, reducing or eliminating the need for rope and pulley arrangements at ground level where they are liable to vandalism.

One or more embodiments of the invention provide a simpler, safer and more economic tensile structural system than existing systems, for example of forming a billboard structure and replacing membrane ties comprising billboard advertisements at frequent intervals.

One or more embodiments of the invention enable the adoption of environmentally friendly materials, for example polyethylene fabric printed with UV-cured ink, which can be recycled after use, compared to existing systems, for example self-adhesive PVC film printed with solvent-based PVC inks, which are very undesirable materials, requiring landfill with the attendant chemical emigration problems of PVC.

In summary, various embodiments of the invention can be used in many different types of tensile structures and the embodiments illustrated are not limitive. The foregoing description is included to illustrate the operation of the preferred embodiments and is not meant to limit the scope of the invention. To the contrary, those skilled in the art should appreciate that variations may be constructed and employed without departing from the scope of the invention, aspects of which are recited by the claims appended hereto.

The invention claimed is:

1. A method of assembling a tensile fabric arrangement, the method comprising:

(i) engaging an end of a carrier member having a tensile fabric attached thereto with a first support member attached to a surface;

(ii) engaging a second end of the carrier member with a locking member;

(iii) extending the tensile fabric from the carrier member;

(iv) engaging an end of a second carrier member for the tensile fabric with a second support member attached to the surface;

(v) engaging a second end of the second carrier member with a securing member; and (vi) applying a tension to the tensile fabric, wherein the tensile fabric is supported at its top edge only by the first and second support members and wherein the method is carried out in the order: (i), (ii), (iii), (iv), (v), and (vi), or in the order (iv), (v), (iii), (i), (ii) and (vi).

2. A method according to claim 1, wherein the tensile fabric is further supported at its top edge using a tensile structural assembly comprising one or more discrete guide hooks.

3. A method according to claim 2, wherein the tensile structural assembly further comprises a surface, a loop and a tie, wherein the guide hook is fixed to the surface and comprises a guide section and a hook section, wherein the loop is attached to or forms part of the tie, wherein the loop is retained by the guide hook, and wherein the loop and the tie are in tensile stress.

4. A method according to claim 1, wherein the locking member is a ratchet hook.

5. A method according to claim 1, wherein the support members are hoops and the carrier members are poles.

6. A method according to claim 1, wherein the tensile fabric is a polyethylene-based composition.

7. A method according to claim 1, wherein further tension is applied to the tensile fabric using a tensile structural assembly comprising a surface, a guide hook, a loop and a tie, wherein the guide hook is fixed to the surface, wherein the guide hook comprises a guide section and a hook section, wherein the loop is attached to or forms part of the tie, wherein the loop is retained by the guide hook, and wherein the loop and the tie are in tensile stress.

* * * * *